US006612854B2

(12) United States Patent
Takata

(10) Patent No.: US 6,612,854 B2
(45) Date of Patent: Sep. 2, 2003

(54) SLIDER-EQUIPPED CONNECTOR AND CONNECTOR

(75) Inventor: Kensaku Takata, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 42 days.

(21) Appl. No.: 09/917,951

(22) Filed: Jul. 31, 2001

(65) Prior Publication Data

US 2002/0019160 A1 Feb. 14, 2002

(30) Foreign Application Priority Data

Aug. 11, 2000 (JP) ..... 2000-244936
Aug. 23, 2000 (JP) ..... 2000-252514

(51) Int. Cl.[7] ..... H01R 13/62
(52) U.S. Cl. ..... 439/157; 439/372
(58) Field of Search ..... 439/157, 372, 439/152, 160

(56) References Cited

U.S. PATENT DOCUMENTS 3,453,586 A 7/1969 Brendlen, Jr.
5,975,929 A 11/1999 Matsuura et al.
6,390,835 B1 * 5/2002 Okabe et al. ..... 439/157

FOREIGN PATENT DOCUMENTS

EP 0 793 304 A2 9/1997
EP 0 889 555 A2 1/1999
JP A 10-21992 1/1998
JP A 11-40250 2/1999

* cited by examiner

*Primary Examiner*—Khiem Nguyen
(74) *Attorney, Agent, or Firm*—Oliff & Berridge, PLC

(57) ABSTRACT

A connector C1 has a housing 10; a cam plate 20 which is swingably attached to the housing 10; and a slider 30 which is relatively slidable with respect to the housing 10. The sliding motion is converted by a cam function of the cam plate 20 into a force of fitting the connector C1 with a counter connector C2. In the housing 10, a latching protrusion 14*a* which disengageably latches the cam plate 20 to a predetermined swinging angle position is disposed.

12 Claims, 12 Drawing Sheets

SLIDER-EQUIPPED CONNECTOR AND CONNECTOR

BACKGROUND OF THE INVENTION

1.Technical Field

The present invention relates to a connector in which an operating force required for fitting with a counter connector is reduced by a cam function.

Further, the present invention relates to a connector having a slider which reduces an operating force required for fitting with a counter connector, and also to a connector device including such a connector.

2. Related Art

Conventionally, a connector having a function of reducing an operating force required for fitting with a counter connector is known in, for example, the Unexamined Japanese Patent Application Publication No. Hei10-021992.

The connector comprises a housing which holds terminals, and a holder which slidably supports the housing. A swinging lever which is a cam member is interposed between the housing and the holder. The swinging lever is attached to the housing so as to be swingable, and has a cam groove which is to be engaged with a pin disposed in a counter connector, and an engagement pin which is to be fitted into a guide groove disposed in the holder. The shapes of the cam groove and the guide groove are set so that, in accordance with relative sliding motion of the housing with respect to the holder in a state where the cam groove of the swinging lever is engaged with the pin of the counter connector and the engagement pin is engaged with the guide groove of the holder, the swinging lever swings with respect to the housing, and a force of fitting the connectors with each other is generated by the swinging.

In the connector, namely, relative sliding motion between the housing and the holder (slider) is converted by the cam function of the swinging lever into a force of fitting the connectors with each other, so that a large fitting force is obtained by a small slide operating force.

Problems to be Solved

Such a connector is assembled in the following manner. First, the swinging lever is attached to the housing so as to be swingable. While the swinging lever is held to a predetermined swinging angle position with fingers or the like in order to prevent the lever from freely swinging, the engagement pin of the swinging lever must be engaged with the guide groove of the holder. This work is complicated and cumbersome, and hence impedes improvement of the production efficiency. When terminals and wires connected thereto are mounted to the housing before the assembly work, it is more difficult to conduct the assembly work because the wires and the like obstruct the work. Therefore, the terminals and the like must be mounted after the assembly work is ended. Consequently, also the work of mounting terminals is cumbersome.

Related Art

Further, conventionally, a connector having a function of reducing an operating force required for fitting with a counter connector is known in, for example, the Unexamined Japanese Patent Application No. Hei11-040250.

The connector comprises a housing which holds terminals, and a support member (slider) which slidably supports the housing. A cam mechanism configured by a swinging lever and the like is interposed between the housing and the support member. In a state where the swinging lever is engaged with a driven pin of the counter connector, the housing and the support member relatively slide over each other, so that the sliding force is converted by the force boosting function of the swinging lever into a fitting force of the connectors which is larger than the sliding force.

In a connector of this kind, the relative position of the support member (slider) with respect to the housing must be held to a predetermined one in a stage where the connector has not yet been coupled with the counter connector. As means for this, the following configuration is disclosed in the patent publication. A movable arm (flexible piece) is elongated from the support member toward the housing, and a protrusion piece which inwardly protrudes is formed on an inner side face of a hood formed in the housing. A tip end portion of the movable arm abuts against the protrusion piece to fix the relative position of the housing and the support member to an initial position (provisional latching). Under this state, when this housing is to be fitted with the housing of the counter connector, a tip end portion of the housing of the counter connector pressingly opens from the inner side the tip end portion of the movable arm, whereby the provisional latching is compulsively canceled.

Problems to be Solved

In the connector disclosed in the patent publication, the movable arm for provisional latching is shaped so as to be largely elongated from the support member toward the housing. Therefore, the size of the support member is increased by the degree corresponding to the length of the movable arm, and the movable arm is easily broken in a step of transporting the support member, a step immediately before assembling, or the like. Consequently, it is difficult to handle of the connector.

SUMMARY OF THE INVENTION

In view of such circumstances, it is an object of the invention to facilitate the work of assembling the whole of a connector and improve the production efficiency of the connector while connector fitting by a small operating force is enabled by a cam function.

Means for Solving the Problems

As means for attaining the object, the invention provides a connector wherein the connector comprises: a housing which holds a terminal that is to be fitted with a counter connector; a slider which is attached to the housing to be relatively slidable; and a cam member having a first cam portion which is engageable with a cam component disposed in the counter connector, and a second cam portion which is engageable with a cam component disposed in the slider, shapes of the first and second cam portions are set so that, when the slider relatively slides with respect to the housing in a state where the first cam portion is engaged with the cam component of the counter connector and the second cam portion is engaged with the cam component of the slider, a sliding force is converted by a cam function of the cam member into a fitting force of the connectors which is larger than the sliding force, and a latching portion is disposed in the housing, the latching portion disengageably latching the cam member to a swinging angle position where the second cam portion is engageable with the slider.

According to this configuration, the cam member is latched to a predetermined swinging angle position by the latching portion disposed in the housing, and hence the slider can be mounted to the housing without difficulty while maintaining the latched state. The latching of the cam member by the latching portion is canceled during or after the mounting. When the connector is to be fitted with the counter connector, the cam member is enabled to exert the cam function. Namely, fitting of the connector with the counter connector at a sufficient force can be realized simply by relatively sliding the housing and the slider over each other by a relatively small operating force.

The latching of the cam member may be canceled by directly operating the latching portion with, for example, fingers. Alternatively, a configuration may be employed in which a latching canceling portion which, when the slider is to be engaged with the second cam portion, compulsively cancels the latching of the cam member by the latching portion is disposed in the slider. According to this configuration, when the slider is to be mounted (i.e., the slider is to be engaged with the second cam portion), the latching canceling portion automatically cancels the latching of the cam portion, and hence the assembly work can be further simplified.

As a specific configuration for canceling the latching, preferably, a bending portion which is flexurally deformable in directions along which the bending portion is contacted with and separated from the slider is disposed in the housing, the latching portion is disposed in the bending portion, and, when the slider is to be engaged with the second cam portion, the latching canceling portion of the slider flexurally deforms the bending portion to displace the latching portion of the bending portion, thereby compulsively canceling the latching.

According to this configuration, by using flexural deformation (elastic deformation) of the bending portion, latching of the cam member by the latching portion disposed in the bending portion, and cancellation of the latching can be easily switched over.

In this case, preferably, the latching canceling portion is, for example, a latching canceling protrusion which protrudes in a direction toward the bending portion, and the latching canceling protrusion presses the bending portion to flexurally deform the bending portion.

With respect to the second cam portion and the cam component to be engaged therewith, preferably, a configuration may be employed in which the second cam portion is a cam protrusion which protrudes toward the slider, a cam groove into which the cam protrusion is to be fitted is disposed in a side wall of the slider, and, during a period when the slider reaches a position where the cam protrusion is fitted into the cam groove, the side wall of the slider in which the cam groove is disposed overrides the cam protrusion while being flexurally deformed. According to this configuration, even in a state where the cam member is previously attached to the housing, the side wall of the slider overrides the cam protrusion disposed on the cam member while being bent, whereby the slider can be easily caused to reach the position (mounting position) where the cam protrusion is fitted into the cam groove disposed in the side wall of the slider.

As described above, in the connector according to the invention, mounting of the slider can be easily conducted while the cam member is latched to a predetermined swinging angle position in the housing. Before the slider is mounted, for example, a terminal connected with a wire can be mounted to the housing. Unlike the conventional case where mounting of a terminal connected with a wire must be conducted after a slider is mounted, therefore, the slider may have a shape which covers from a rear side a wire connected to the terminal held by the housing, so that the slider can be used also as a wire cover.

Further, in view of such circumstances, it is another object of the invention to provide a slider-equipped connector and a connector device which can be easily handled and has a compact structure, and in which fitting of connectors is enabled by a small operating force.

Means for Solving the Problems

As means for attaining the object, the invention provides a slider-equipped connector comprises: a housing having a terminal holding portion which holds a terminal that is to be fitted with a counter connector; a slider which is attached to the housing to be relatively slidable; and a force boosting mechanism which is interposed between the slider and the housing, and which converts a relative sliding force between the slider and the housing, into a fitting force with respect to the counter connector, the fitting force being larger than the sliding force, a hood which surrounds the terminal holding portion with forming a gap between the portion and the hood is formed on the housing, and a provisionally latching portion is formed between the hood and the terminal holding portion, the provisionally latching portion provisionally latching the slider to a slide initial position in a state where the connector has not yet been fitted with the counter connector, and being flexurally deformed to cancel the provisional latching.

In the slider-equipped connector, the provisionally latching portion is accommodated in a space between the terminal holding portion of the housing and the hood, and hence the housing can be maintained to have a compact structure although the provisionally latching portion is formed. Since the provisionally latching portion is protected from the outside by the hood, there is no fear that the provisionally latching portion is erroneously broken in a step of transporting the housing, a step immediately before assembling, or the like. Therefore, the connector can be easily handled.

When the relative position of the housing and the slider is fixed to a predetermined one (i.e., the slider is provisionally latched to the slide initial position) and an operation of fitting the slider-equipped connector with the counter connector is then started, the operating portion of the counter connector bends the provisionally latching portion to cancel the provisional latching of the provisionally latching portion, so as to attain a state where the housing and the slider can relatively slide over each other. The sliding force is converted by the force boosting mechanism into a large fitting force of the connectors, whereby fitting of the connectors is enabled by a small operating force for sliding.

The provisionally latching portion may be formed on the side of the terminal holding portion of the housing. More preferably, the provisionally latching portion may elongate from an inner side face of the hood of the housing in a connector fitting direction, and may have a shape in which an end portion is flexurally deformable in directions along which the end portion is contacted with and separated from the inner side face of the hood. When the provisionally latching portion is integrated with the hood in this way, the degree of freedom in design of the terminal holding portion, i.e., the body of the housing is enhanced, and the shape of the housing of the counter connector which is to be fitted with the terminal holding portion can be simplified.

For example, a waterproof sealing member which is to be in contact with a housing of the counter connector may be disposed on an outer peripheral face of the terminal holding portion. This enables an excellent waterproof structure to be easily constructed.

In the case where the provisionally latching portion is formed on the side of the hood, the hood may have a shape which allows the flexible end portion of the provisionally latching portion to be locally exposed to an outside of the hood, whereby the flexible end portion is enabled to be bent by a manual operation with using, for example, fingers.

Therefore, the provisional latching can be canceled by such a manual operation in a stage where the slider has been provisionally latched to the housing and the connector has not yet been fitted with the counter connector.

Furthermore, the invention provides a connector device wherein the device comprises the slider-equipped connector and a counter connector having a housing that is to be fitted with the housing of the slider-equipped connector, and an operating portion is disposed in the counter connector, the operating portion, when the counter connector is to be fitted with the slider-equipped connector, operating the provisionally latching portion of the slider-equipped connector to deform the provisionally latching portion in a direction along which the provisional latching of the slider is canceled.

In the case where, as described above, the provisionally latching portion elongates from an inner side face of the hood of the housing in the connector fitting direction, and has a shape in which an end portion is flexurally deformable in the directions along which the end portion is contacted with and separated from the inner side face of the hood, and the counter connector has a hood which is to be fitted with an outer side of the terminal holding portion of the slider-equipped connector, the provisional latching of the provisionally latching portion can be canceled by a simple configuration in which an operation protrusion is formed on an outer peripheral face of the hood, the operation protrusion, when the counter connector is to be fitted with the slider-equipped connector, pressingly operating from an inner side the provisionally latching portion of the slider-equipped connector to deform the flexible end portion of the provisionally latching portion in a direction along which the provisional latching of the slider is canceled.

DETAILED DESCRIPTION OF THE PREFERRED EMBODIMENTS

[Mode for Carrying Out the Invention]

(First Embodiment)

A preferred embodiment of the invention will be described with reference to the accompanying drawings.

Figure 1:
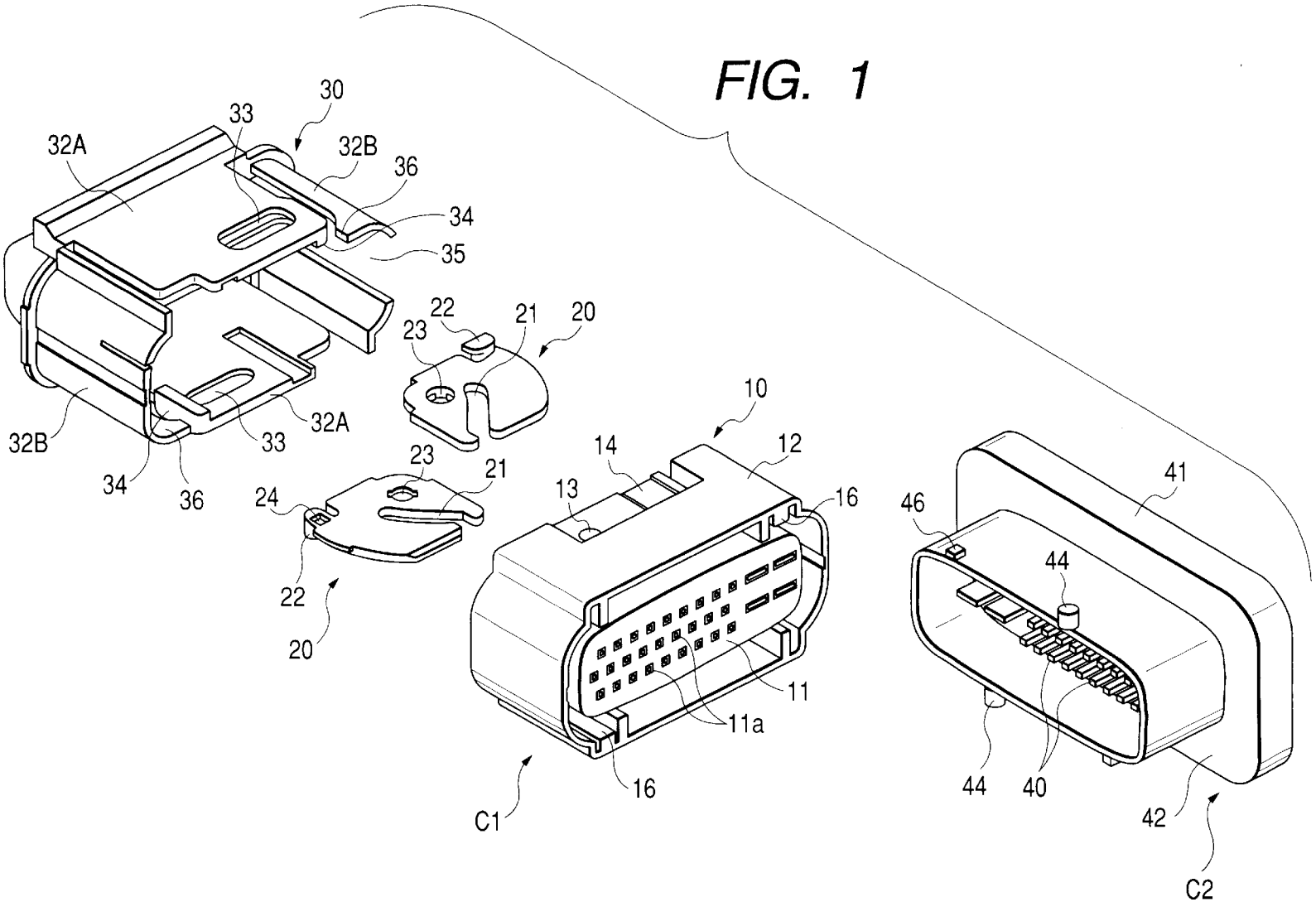
FIG. 1 is a perspective view showing a connector of an embodiment of the invention, and a counter connector.

FIG. 1 shows a connector C1 according to the invention, and a counter connector C2.

The counter connector C2 comprises a large number of terminals 40 which longitudinally elongate, and a resin-made housing 41 which holds the terminals 40. A hood 42 which externally surrounds the terminals 40 is formed on the housing 41. A pair of upper and lower cam pins 44, and a pair of upper and lower operation protrusions 46 are formed on the outer peripheral face of the hood 42.

By contrast, the connector C1 according to the invention comprises a housing 10, a pair of upper and lower cam plates (cam member) 20, and a slider 30.

The housing 10 is integrally formed as a whole by an elastic insulating material such as a resin, and has a terminal holding portion 11 having a block-like shape, and a hood 12 which covers the periphery of the terminal holding portion.

In the terminal holding portion 11, a large number of terminal accommodating chambers 11*a* are disposed so as to longitudinally pass through the terminal holding portion. Connector terminals (not shown) are held in the terminal accommodating chambers 11*a*, respectively, and wires connected to the connector terminals are led out to the rear side (the side where the slider 30 which will be described later is positioned) of the housing 10.

On each of the upper and lower faces of the terminal holding portion 11, a support shaft portion 13 protrudes in a position in the vicinity of the rear end, and a bending piece (bending portion) 14 is formed.

Figure 3A:
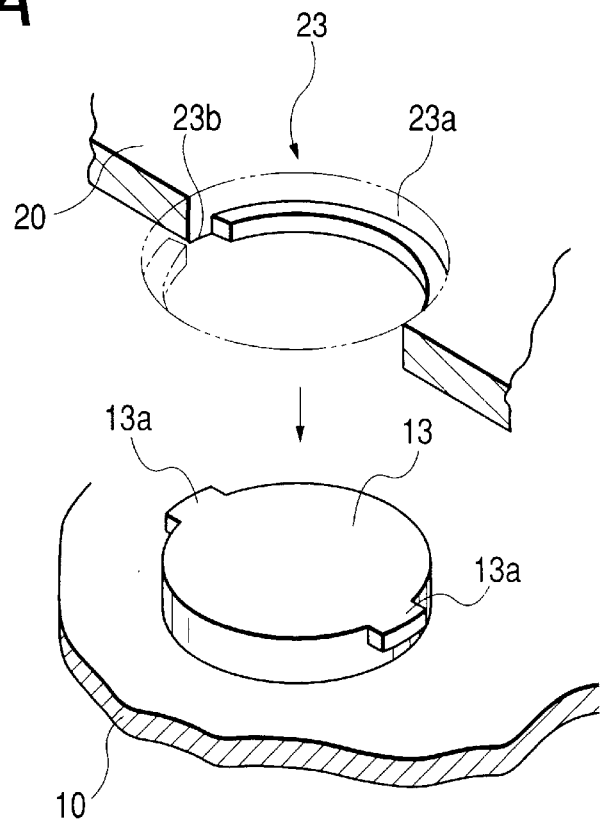
FIG. 3A is a cutaway perspective view showing a state where a cam plate has not yet been mounted to a support shaft portion of the housing shown in FIGS. 1 and 13.
Figure 3B:
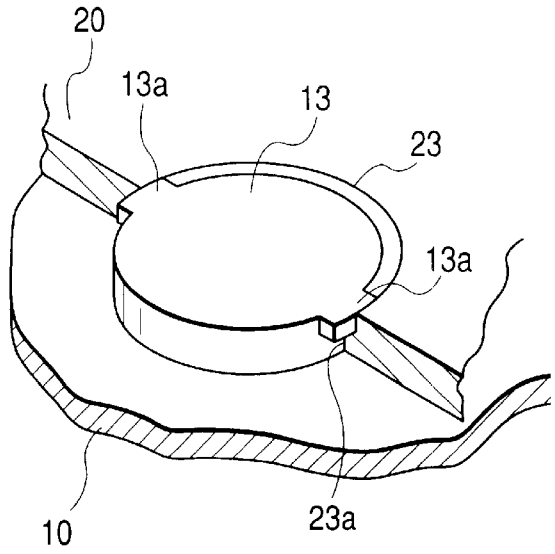
FIG. 3B is a cutaway perspective view showing a state where the cam plate has been mounted shown in FIGS. 1 and 13.

The support shaft portions 13 function as swing fulcrums for the cam plates 20, and have a shape which is shown in detail in FIGS. 3A and 3B. Specifically, each of the support shaft portions 13 has a substantially columnar shape, and a pair of ears 13*a* protrude radially outward at an interval of 180° from a tip end side portion (in FIG. 3, the upper portion)

Figure 7:
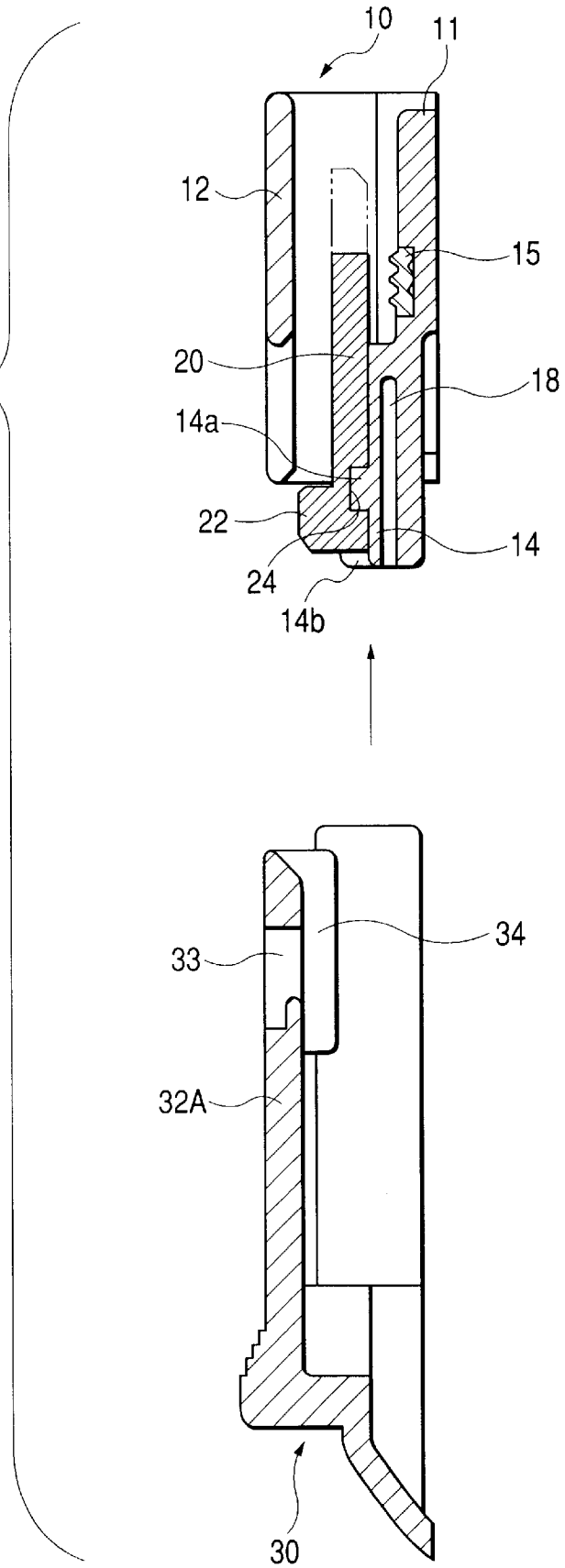
FIG. 7 is a section view taken along the line A—A of FIG. 2.
Figure 8:
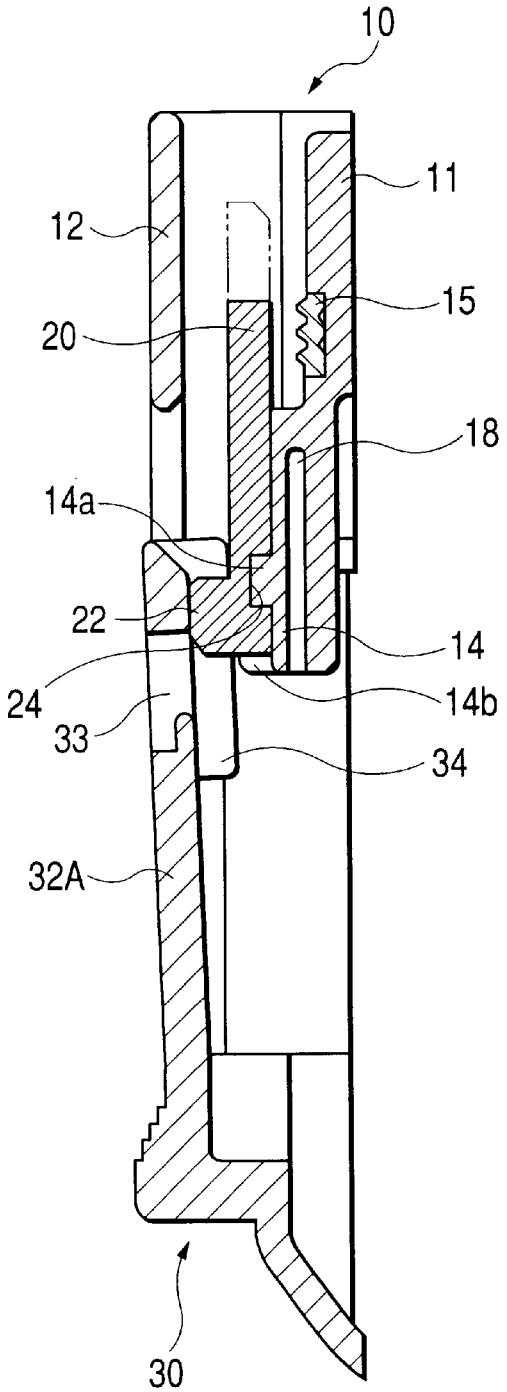
FIG. 8 is a section view corresponding to FIG. 7 and showing a state where the slider starts to be mounted to the housing.
Figure 9:
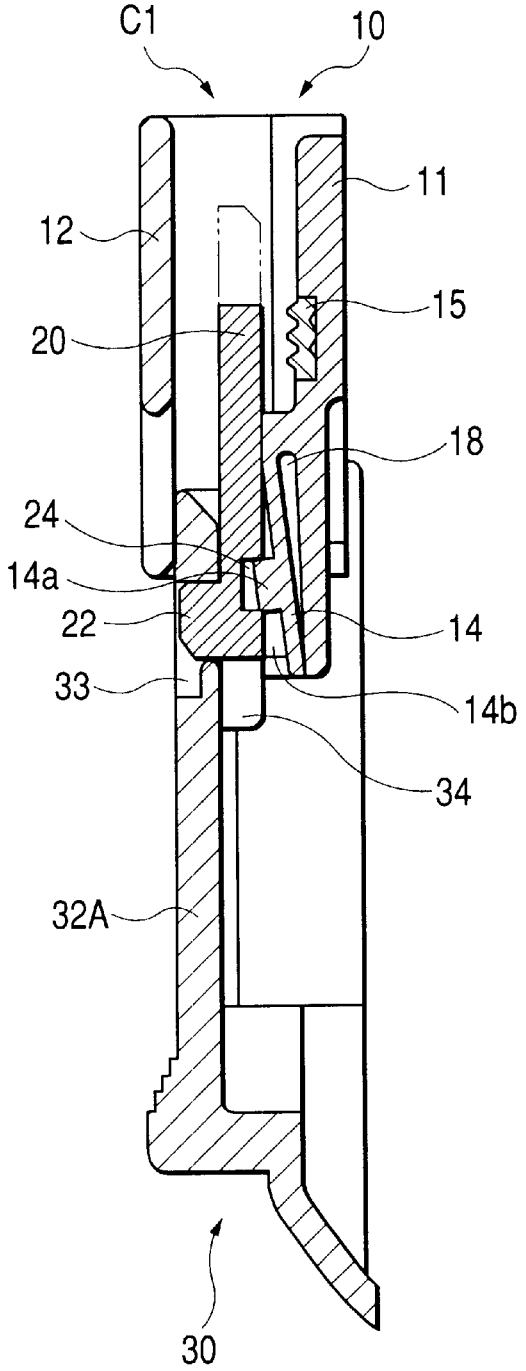
FIG. 9 is a section view corresponding to FIG. 7 and showing a state where the slider has been mounted to the housing.

Each of the bending pieces 14 has a shape in which a tip end portion (the rear portion of the housing 10; in FIG. 2, the lower portion) can be flexurally deformed toward the inner side of the housing 10. As shown in FIGS. 7 to 9, specifically, a slit 18 which cuts into a peripheral portion of the terminal holding portion 11 from the rear side (the lower side in FIG. 7) is formed, so that the outer side with respect to the slit 18 functions as the bending piece 14. Therefore, the bending piece 14 can be inward flexurally deformed by a degree corresponding to the thickness of the slit 18. On the outer side face of the bending piece 14, a latching protrusion (latching portion) 14*a* for latching (restricting swinging of)

the corresponding cam plate 20 is formed, and a pressed protrusion 14*b* is formed in a position on the side of the rear end (the lower end side in FIG. 7) with respect to the latching protrusion 14*a*.

In FIGS. 7 to 9, 15 denotes a waterproof sealing member which, when the connector is fitted with the counter connector C2, is to be in contact with the counter connector C2.

In an area between the terminal holding portion 11 and the hood 12, a pair of front and rear bending pieces 16 are formed. As shown in FIGS. 7 to 9, each of the bending pieces 16 is formed into a cantilevered shape which elongates from the front end (the upper end in the figures) of the hood 12, in a region outside the terminal holding portion 11, and in a reverse direction toward the rear side, and its free end (rear end) can be bent in the outward direction (the direction approaching toward the hood 12). On the inner side face (the face on the side opposed to the terminal holding portion 11) of the bending piece 16, a stopper protrusion 16*a* is formed, and a pressed protrusion 16*b* is formed in a position which is nearer to the front end than the stopper protrusion 16*a*.

Cutaways 17 through which the rear end portions (free end portions) 16*c* of the bending pieces 16 are respectively exposed to the outside are formed in a rear end portion of the hood 12, so that the rear end portions 16*c* of the bending pieces 16 can be pressingly operated also through the cutaways 17.

Each of the cam plates 20 has a thin plate-like shape, and has a cam groove (first cam portion) 21, a cam protrusion (second cam portion) 22, and a shaft hole 23.

The cam groove 21 is passed through the cam plate 20 in the thickness direction, and has a smooth curve-like shape. The cam protrusion 22 protrudes toward the outside of the housing 10 in a position which is substantially diagonal to the cam groove 21. The shapes and positions of the cam groove 21 and the cam protrusion 22 are set so that, during an operation of coupling the connectors C1 and C2 with each other, the cam function which will be described later is obtained in a state where the cam pin 44 of the counter connector C2 D enters the cam groove 21 and the cam protrusion 22 is fitted into a cam groove 33 (which will be described later) of the slider 30.

The shaft hole 23 is a hole into which the support shaft portion 13 is to be fitted, and has a shape which is specifically shown in FIGS. 3A and 3B. Namely, the shaft hole 23 has a circular shape the diameter of which allows the protrusions 13*a* of the support shaft portion 13 to enter the hole. In the inner side in the thickness direction of the cam plate 20 (the lower side in FIG. 3), however, arcuate ridges 23*a* protrude radially inward from the inner peripheral face of the shaft hole 23 with leaving a pair of gaps 23*b* into which the protrusions 13*a* respectively enter.

Therefore, the support shaft portion 13 is fitted into the shaft hole 23 by entering the protrusions 13*a* into the gaps 23*b* at angle positions where the gaps 23*b* coincide with the protrusions 13*a*, respectively (FIG. 3A). After the fitting, the cam plate 20 is swung about the support shaft portion 13 to cause the protrusions 13*a* to override the ridges 23*a* (FIG. 3B), thereby preventing the cam plate 20 from slipping off from the support shaft portion 13. Namely, the cam plate 20 can be attached to the housing 10 so that the cam plate 20 is swingable about the support shaft portion 13.

In the invention, the specific structure for attaching the cam member to the housing is not particularly restricted. For example, a retaining ring or the like may be used in addition to the cam member. In summary, the structure is requested only to be configured so that the cam member is swingable with respect to the housing.

Figure 2:
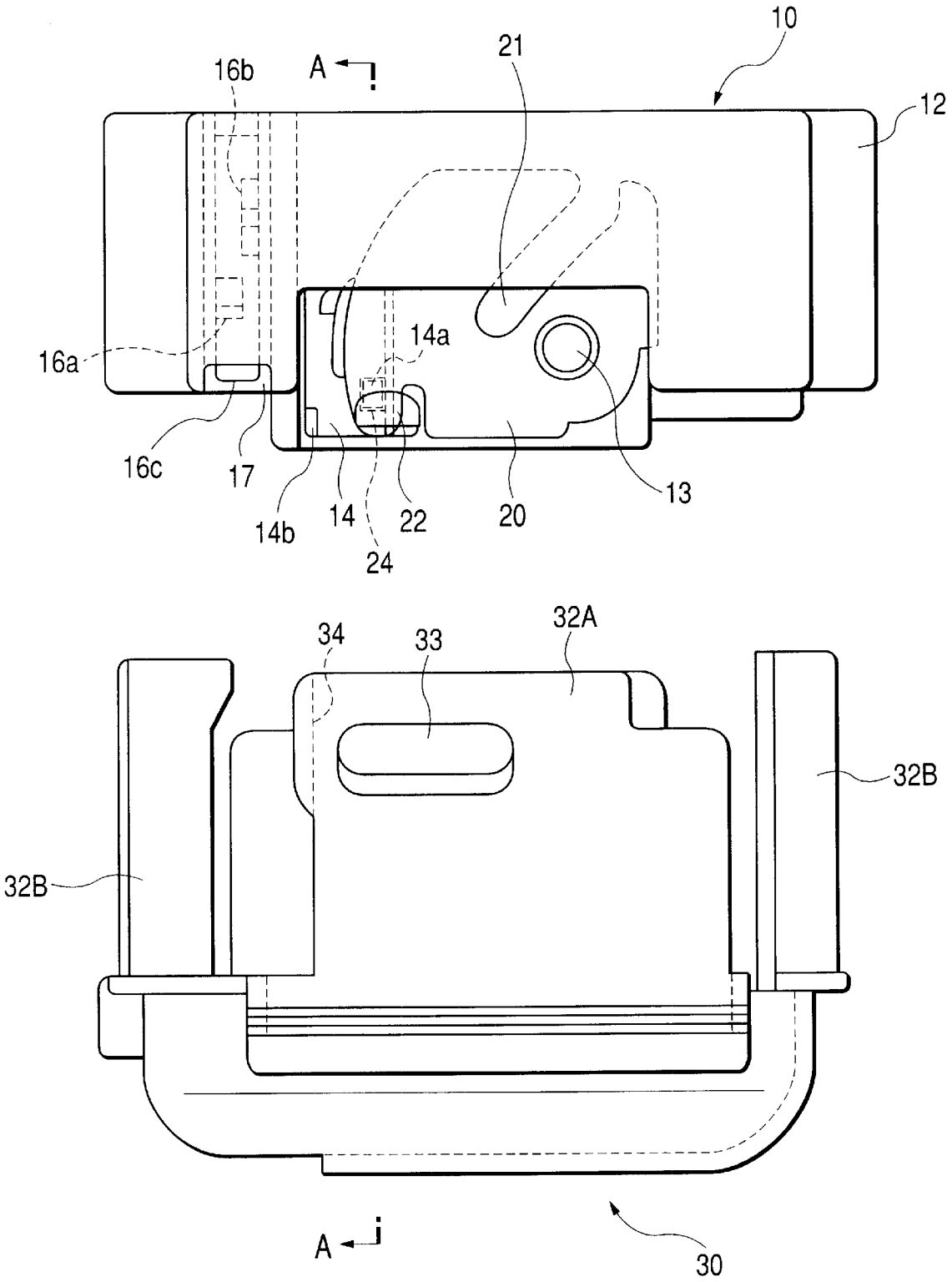
FIG. 2 is a plan view showing a state where a slider has not yet been mounted to a housing of the connector shown in FIGS. 1 and 13.

On the rear side of the cam protrusion 22, formed is a recess (latched portion) 24 which is substantially identical in shape with the latching protrusion 14*a* on the housing 10. When the protrusion 14*a* is fitted into the recess 24, the cam plate 20 is latched to the swinging angle position. As shown in FIG. 2, the latching angle position is set to an angle position where the cam protrusion 22 of the cam plate 20 is positioned just at the rear end (the lower end in the figure) of the housing 10.

The slider 30 also is integrally formed as a whole by an elastic insulating material such as a resin in the same manner as the housing 10, and has a cover-like shape which covers the housing 10 from the rear side. More specifically, the slider has integrally a back wall 31 which is placed at the rearmost position, and a circumferential wall which extends from the peripheral edge of the back wall 31. The circumferential wall is divided into a pair of upper and lower flat plate-like side walls 32A, and right and left side walls 32B.

Each of the flat plate-like side walls 32A is configured so that the front end portion can be flexurally deformed in the inner and outer directions of the slider 30. The cam groove 33 is formed in a portion on the side of the front end. The cam groove 33 elongates in the lateral direction, and, in the illustrated example, is passed through the corresponding flat plate-like side wall 32A in the thickness direction. In a front end portion of each of the side walls 32A, a latching canceling protrusion 34 is formed so as to protrude from the inner side face of the wall. The positions of the latching canceling protrusions 34 are set so that, during an operation of mounting the slider 30 to the housing 10, the latching canceling protrusions 34 press the pressed protrusions 14*b* of the bending pieces 14 from the outer side, as shown in FIG. 9.

Figure 10B:
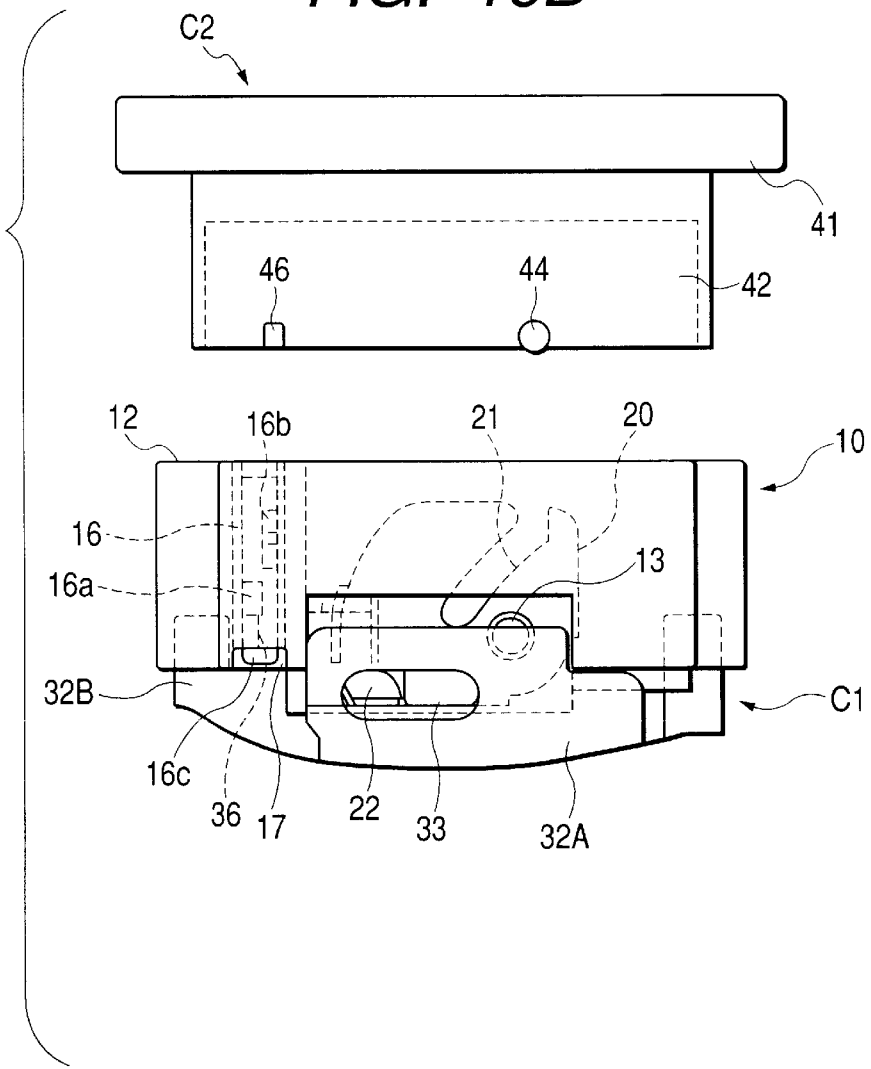
FIG. 10B is a plan view showing the state shown in FIGS. 1 and 13.
Figure 10A:
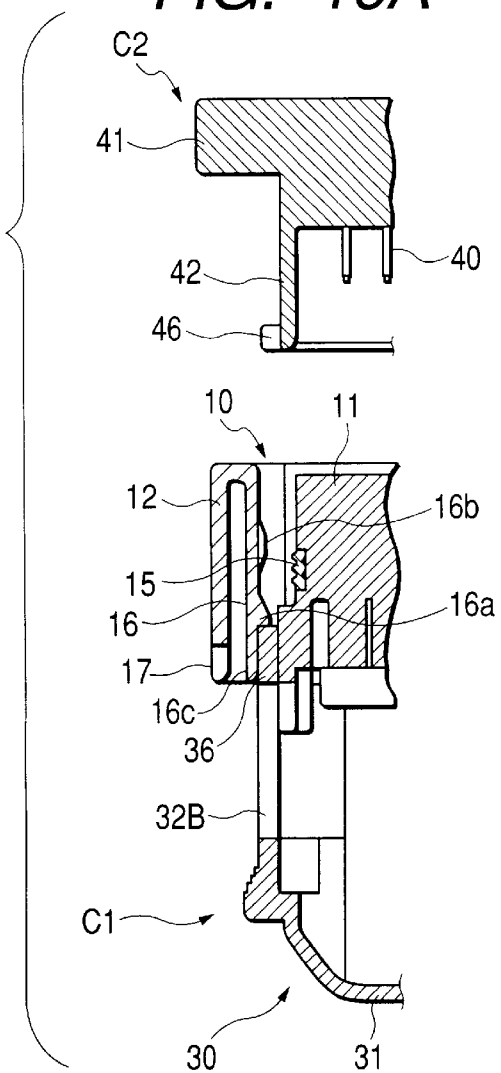
FIG. 10A is a section side view showing a state where the connector has not yet been fitted to a counter connector shown in FIGS. 1 and 13.

By contrast, in each of the right and left side walls 32B of the slider 30, a latched protrusion 36 which protrudes in the circumferential direction from a corner portion of the right or left side wall 32B is formed in a position corresponding to the bending piece 16. As shown in FIGS. 10A and 10B, the latched protrusions 36 bump from the rear side against the stopper protrusions 16*a* of the bending pieces 16, whereby the slider 30 is restricted from being further moved beyond the bumping position.

A wire take-out groove 35 for leading a wire group D (see FIGS. 4 to 6 and 12B) connected to terminals of the housing 10 to the outside of the slider 30 is formed in one of the right and left side walls 32B.

Next, the manner of assembling the connector C1 and that of coupling the connector to the counter connector C2 after assembling will be described. The method of assembling the connector according to the invention is not restricted to this.

1) Attachment of the Cam Plates 20

In the manner shown in FIGS. 3A and 3B, the cam plates 20 are attached to the housing 10 so that the cam plates 20 are swingable about the respective support shaft portions 13. The latching protrusions 14*a* of the housing 10 are fitted into the recesses 24 of the rear faces of the cam plates 20 to latch the cam plates 20 to a predetermined swinging angle position. This latching allows the subsequent steps to be smoothly conducted even when the cam plates 20 are not held with fingers or the like unlike the conventional art.

2) Mounting of Terminals

Terminals fixed to ends of wires are inserted into the terminal accommodating chambers 11*a*, respectively, and then fixed thereto. As a result of this step, the wire group D (FIGS. 4 to 6) connected to the terminals rearward elongates from the housing 10. The order of steps 1) and 2) may be inverted.

3) Attachment of the Slider 30

Figure 4:
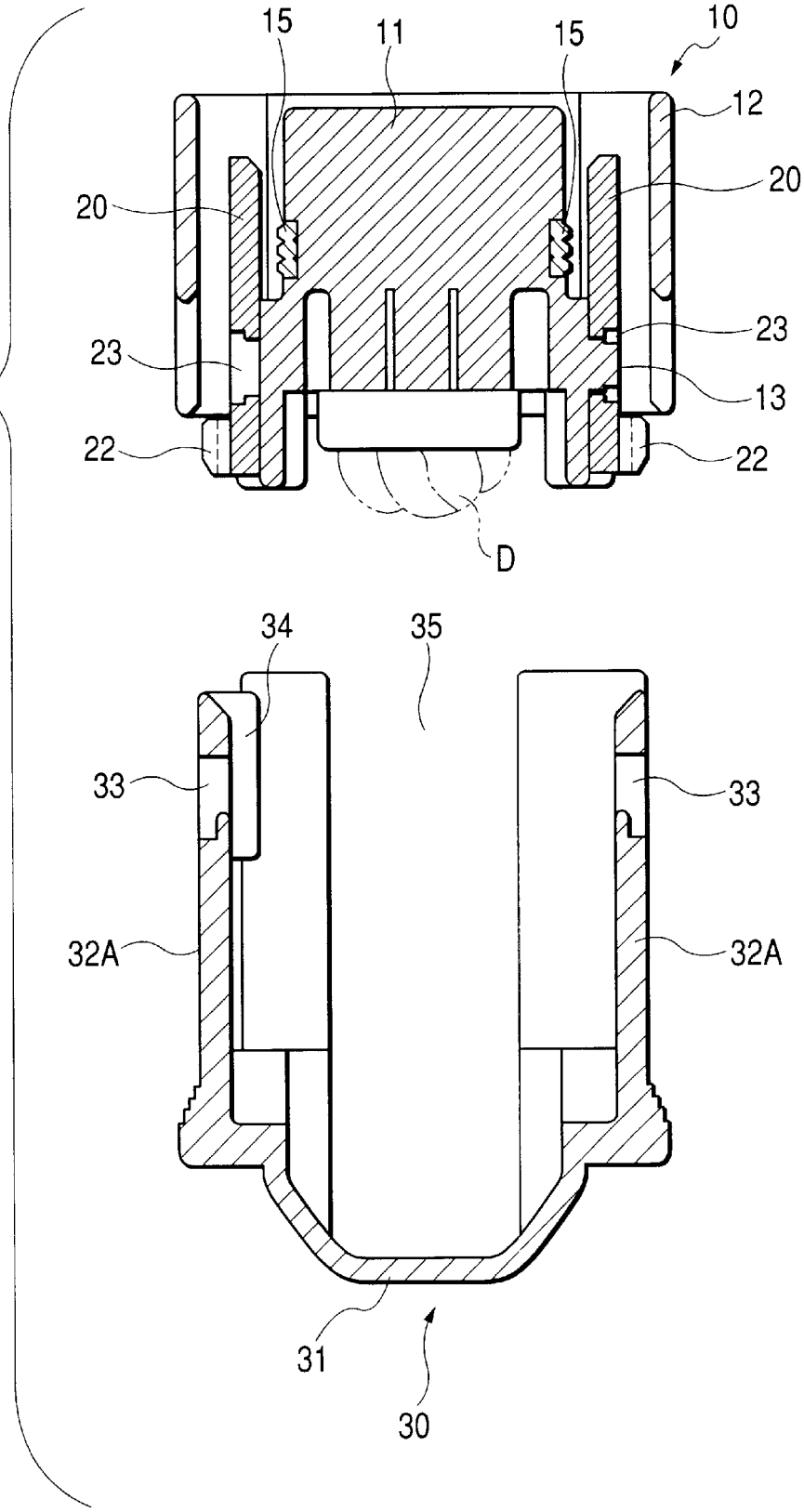
FIG. 4 is a section side view showing a state where the slider has not yet been mounted to the housing shown in FIGS. 1 and 13.
Figure 5:
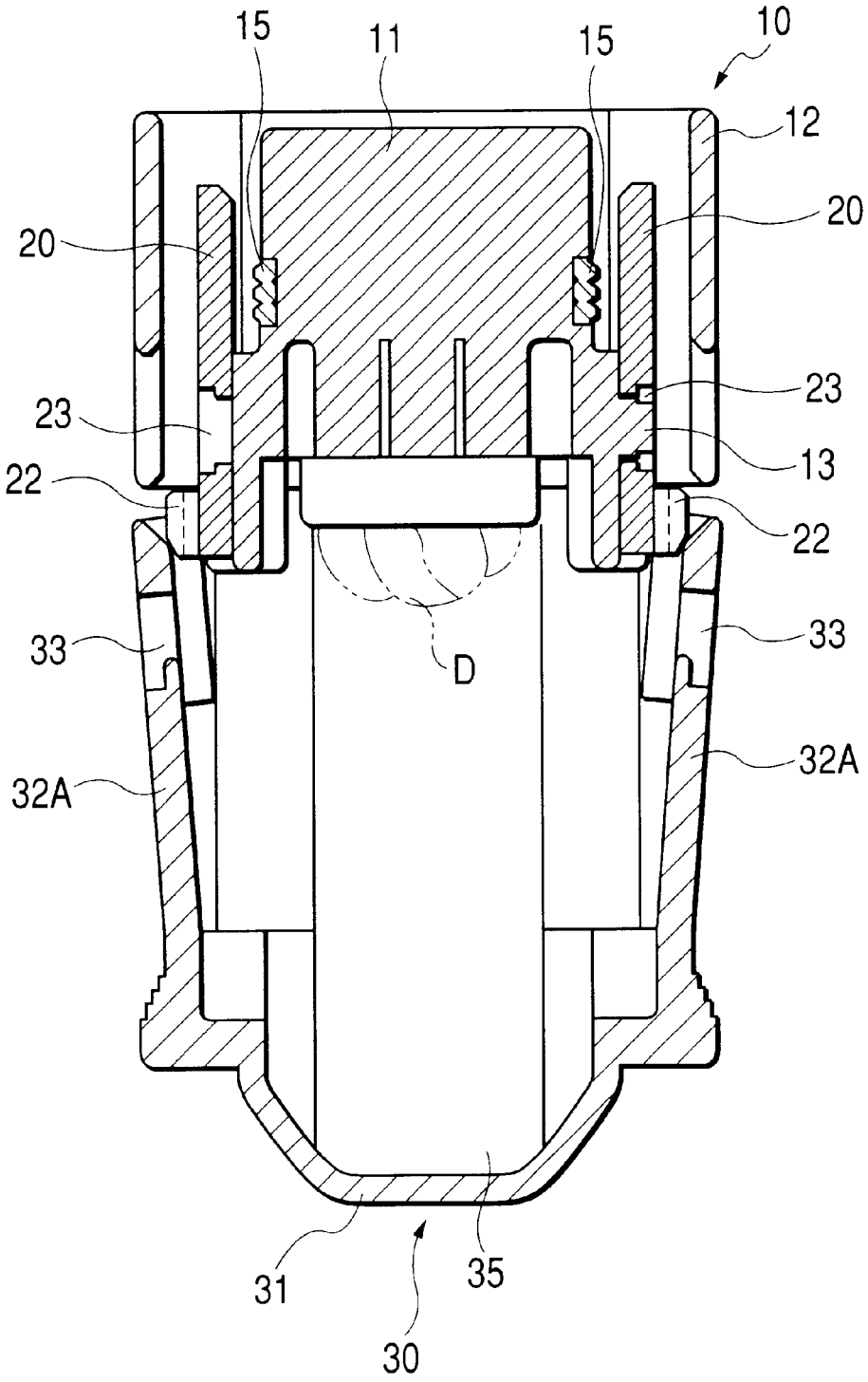
FIG. 5 is a section side view showing a state where the slider starts to be mounted to the housing shown in FIGS. 1 and 13.
Figure 6:
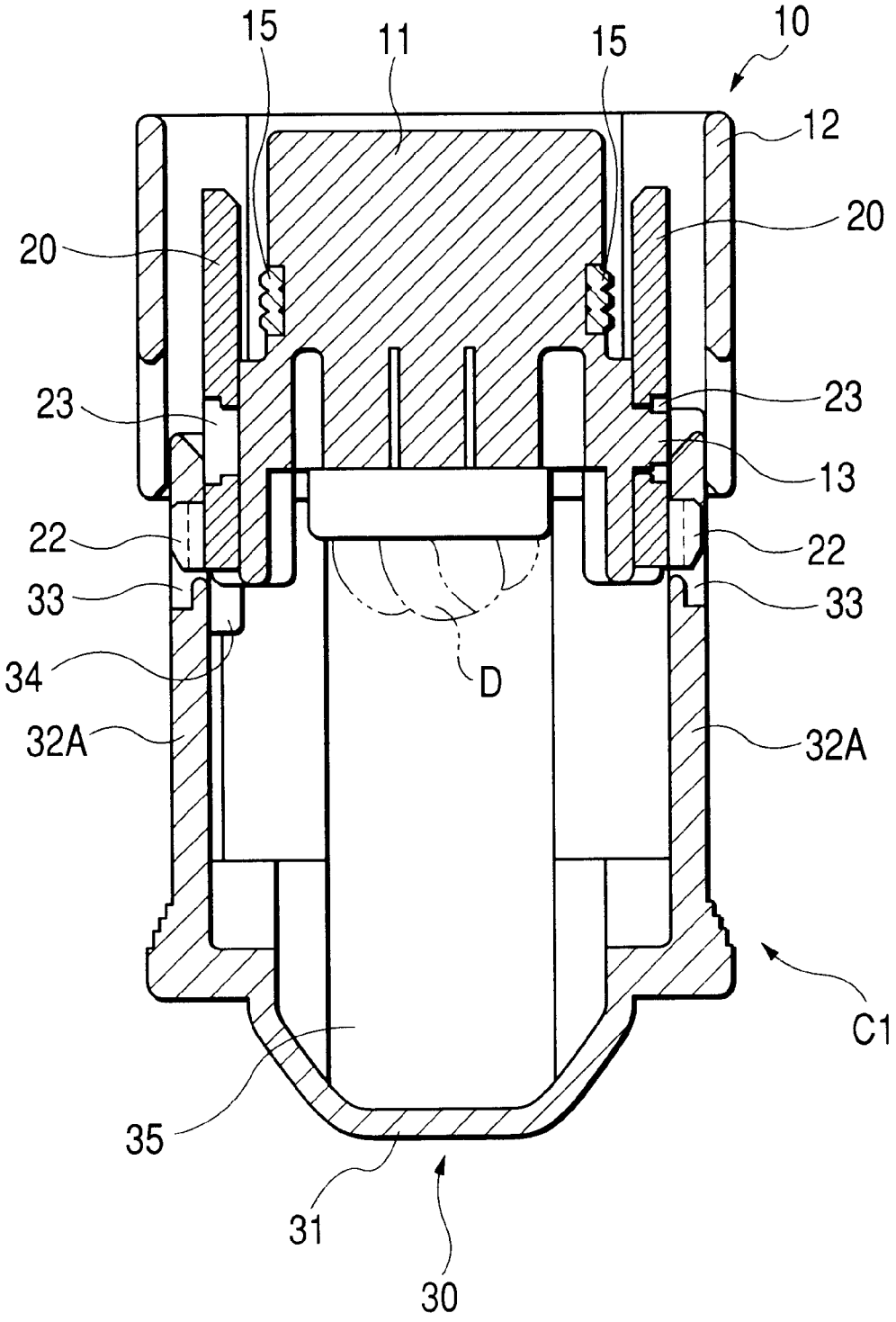
FIG. 6 is a section side view showing a state where the slider has been mounted to the housing shown in FIGS. 1 and 13.

The slider 30 is mounted to the outer side of the housing 10 from the rear side of the housing 10 (FIGS. 4 to 6). During this mounting, as shown in FIG. 5, the flat plate-like side walls 32A of the slider 30 are outward flexurally deformed to override the cam protrusions 22 of the cam plates 20, and finally reaches a mounting position (FIG. 6) where the cam protrusions 22 are fitted into the cam grooves 33. In this mounting position, as shown in FIG. 10, the latched protrusions 36 of the slider 30 bump from the rear side against the stopper protrusions 16*a* of the bending pieces 16 of the housing 10. Therefore, the slider 30 is restricted from being forward moved beyond the mounting position.

At the timing when the slider 30 reaches the mounting position, as shown in FIG. 9, the latching canceling protrusions 34 disposed on the slider 30 press from the outer side the pressed protrusions 14*b* formed on the bending pieces 14, whereby the bending pieces 14 are inward bent. Therefore, the latching protrusions 14*a* formed on the bending pieces 14 are inward separated from the recesses 24 of the cam plates 20. Namely, the latching of the cam plates 20 by the latching protrusions 14*a* is automatically canceled to enable the cam plates 20 to exert the cam function.

In other words, swinging of the cam plates 20 is restricted by the latching protrusions 14*a* until the latching is canceled. Therefore, it is not required to conduct the work of mounting the slider 30 while nipping the cam plates 20 with fingers or the like, and hence the mounting work can be largely facilitated. Even when the wire group D is led out from the terminals which are mounted to the housing 10 in step 2) above, consequently, mounting of the slider 30 can be conducted without difficulty. In this way, mounting of the slider 30 is enabled to be conducted after the terminal mounting step, with the result that, as shown in the figures, the slider 30 can be used also as a cover for the wire group D.

When the slider 30 is mounted to the housing 10 in this way, the connector C1 is completed, and a state where the slider 30 covers from the rear side the wire group D (FIGS. 4 to 6) which rearward elongates from the housing 10 is attained. At this time, interference between the slider 30 and the wire group D is prevented from occurring, by the wire take-out groove 35 which is disposed in the side wall 32B of the slider 30.

Figure 11B:
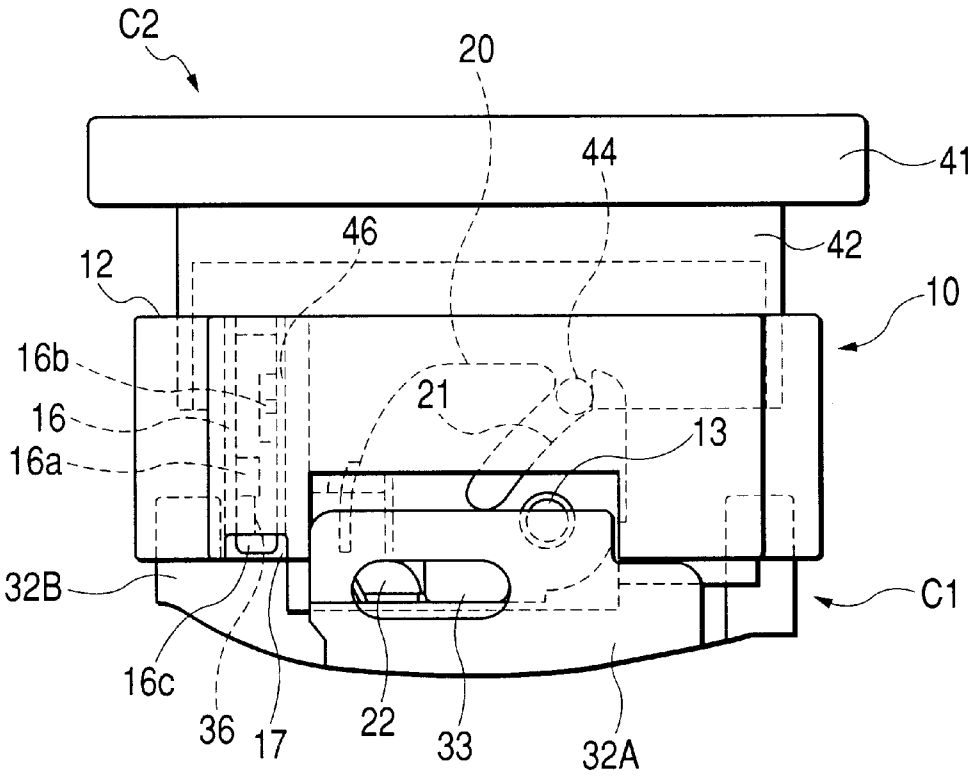
FIG. 11B is a plan view showing the state shown in FIGS. 1 and 13.
Figure 11A:
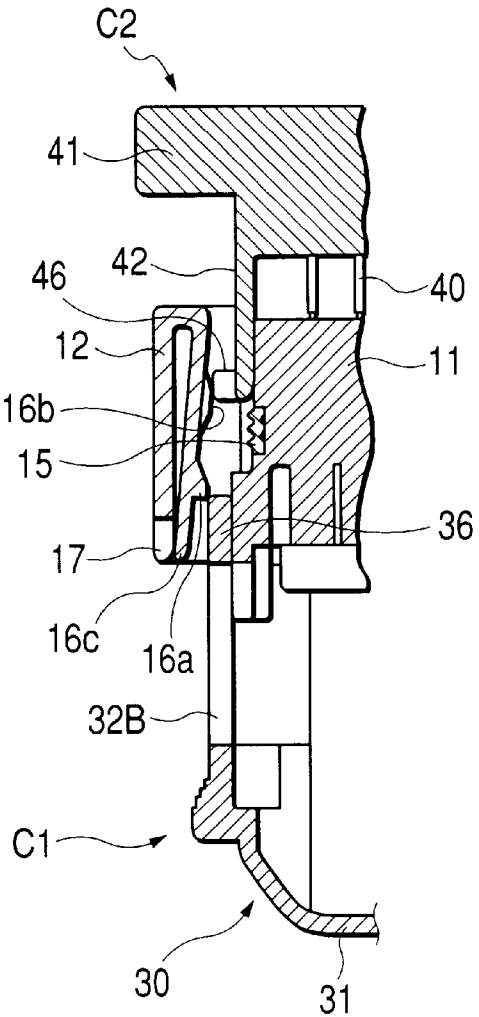
FIG. 11A is a section side view showing a state where the operation of fitting the connector to the counter connector is started shown in FIGS. 1 and 13.
Figure 12B:
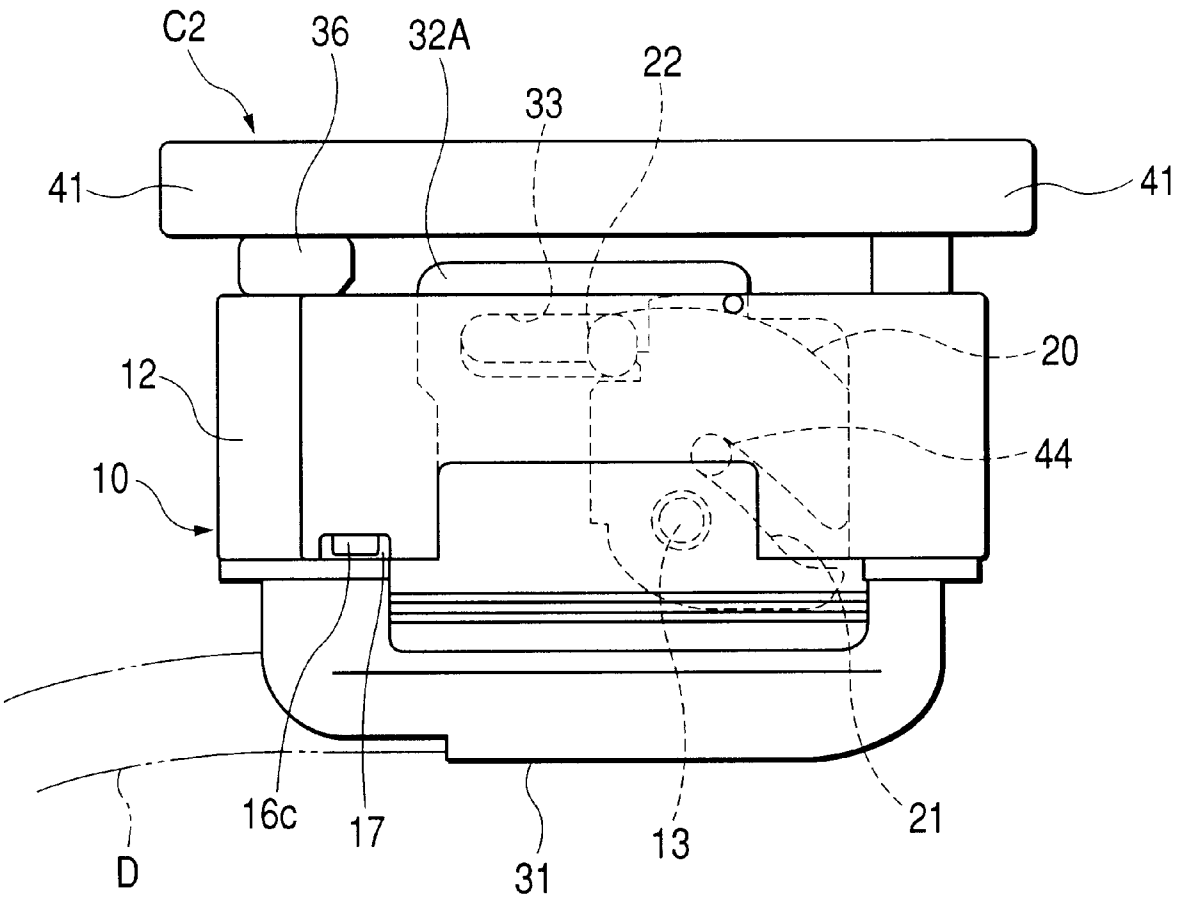
FIG. 12B is a plan view showing the state shown in FIGS. 1 and 13.
Figure 12A:
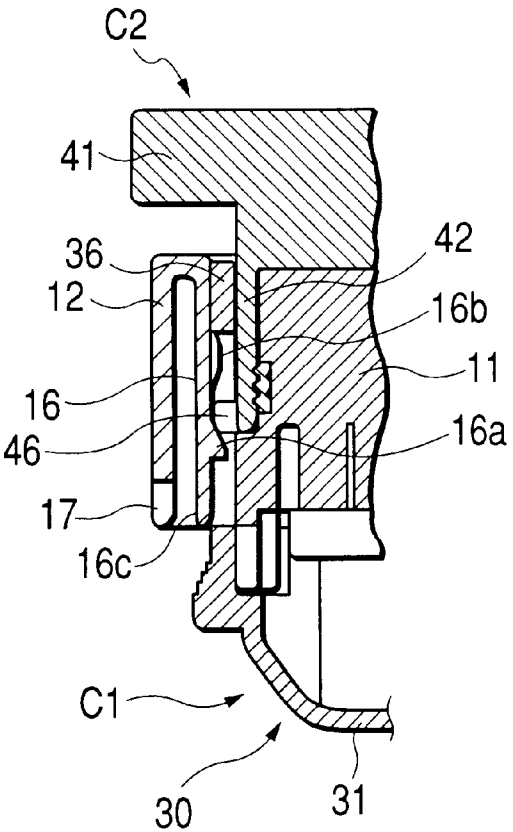
FIG. 12A is a section side view showing a state where the operation of fitting the connector to the counter connector is completed shown in FIGS. 1 and 13.

4) Coupling with the Counter Connector C2 (FIGS. 10 to 12)

In the state where the slider 30 is mounted, the latching (restriction of swinging) of the cam plates 20 by the slider 30 is canceled. However, the cam plates 20 are restrained to the slider 30 by the engagement of the cam protrusions 22 and the cam grooves 33. As shown in FIG. 10, therefore, the cam plates are held to an angle position where the open ends of the cam grooves 21 are opened in the forward direction, or toward the counter connector C2.

Consequently, the operation of fitting the connectors C1 and C2 is performed by: nipping the slider 30 of the connector C1 with fingers or the like; entering the cam pins 44 of the counter connector C2 into the open ends of the cam grooves 21, and inserting the hood 42 of the counter connector C2 into the space defined by the terminal holding portion 11 of the connector C1 and the hood 12. In the fitting operation, the components function in the following manner.

When the hood 42 is to be inserted into the space, the operation protrusions 46 formed on the outer side face of the hood 42 press the pressed protrusions 16*b* of the bending pieces 16 in a direction from the inner side to the outer side as shown in FIG. 11, thereby causing the bending pieces 16 to be outward flexurally deformed. Therefore, the stopper protrusions 16*a* formed on the bending pieces 16 are automatically outward disengaged from the latched protrusions 36 of the slider 30, thereby attaining a state where advancement (relative sliding motion with respect to the housing 10) of the slider 30 is enabled.

When the slider 30 is slidingly advanced as it is at this timing, the cam function between the cam grooves 33 of the slider 30 and the cam protrusions 22 causes the cam plates 20 to swing, and a large force of fitting the connectors C1 and C2 is generated by the cam function between the cam grooves 21 of the cam plates 20 and the cam pins 44. Namely, the operating force for sliding the slider 30 is boosted as a fitting force of the connectors by the cam function, so that the connectors C1 and C2 can be fitted with each other by a small operating force.

An embodiment of the invention is not restricted to that described above. For example, the following embodiments may be employed.

(1) In the embodiment described above, as the first cam portion of each of the cam plates 20, the cam groove 21 is disposed, and, as the cam component which is to be engaged with the first cam portion, the cam pin 44 is disposed in the counter connector C2. In contrast, as the first cam portion of the cam plate 20, a protrusion protruding from the cam plate 20 may be disposed, and a cam groove along which the protrusion is guided may be disposed in the counter connector C2. Similarly, a cam groove may be formed as the second cam portion of the cam plate 20, and a cam protrusion which is to be fitted into the groove may be disposed on the slider 30.

(2) In the embodiment described above, during mounting of the slider 30, the latching canceling protrusions 34 of the slider 30 presses the bending pieces 14, whereby the latching of the cam plates 20 by the latching protrusions 14*a* of the bending pieces 14 is automatically canceled. Alternatively, for example, a configuration may be employed in which engagement and disengagement of the latching protrusions 14*a* and the recesses 24 of the cam plates 20 can be manually conducted by using fingers or the like. Furthermore, the specific latching structure of the cam member such as the cam plates 20 is not restricted. For example, a protrusion may be disposed as a latched portion on the cam member, and a recess into which the protrusion is to be fitted may be disposed in the housing. Alternatively, a latching protrusion disposed on the housing may abut against, for example, the outer peripheral face of the cam member to restrict swinging of the cam member.

(3) In the invention, the specific shape and structure of the slider 30 are not particularly restricted as far as the slider can be attached to the housing 10 so as to be relatively slidable. For example, the slider may be formed into a cylindrical shape which does not have the back wall 31. In this case, in the same manner as the conventional art, the work of mounting terminals may be conducted after the slider 30 is mounted to the housing 10. When mounting of the terminals is conducted before the slider 30 is mounted, however, the work of mounting terminals is further facilitated, and, when the slider 30 is formed into a shape which covers from the rear side the wire group D, it is possible to obtain a further advantage that the slider 30 can be used also as a wire cover.

(Second Embodiment)

A further preferred embodiment of the invention will be described with reference to the accompanying drawings.

Figure 13:
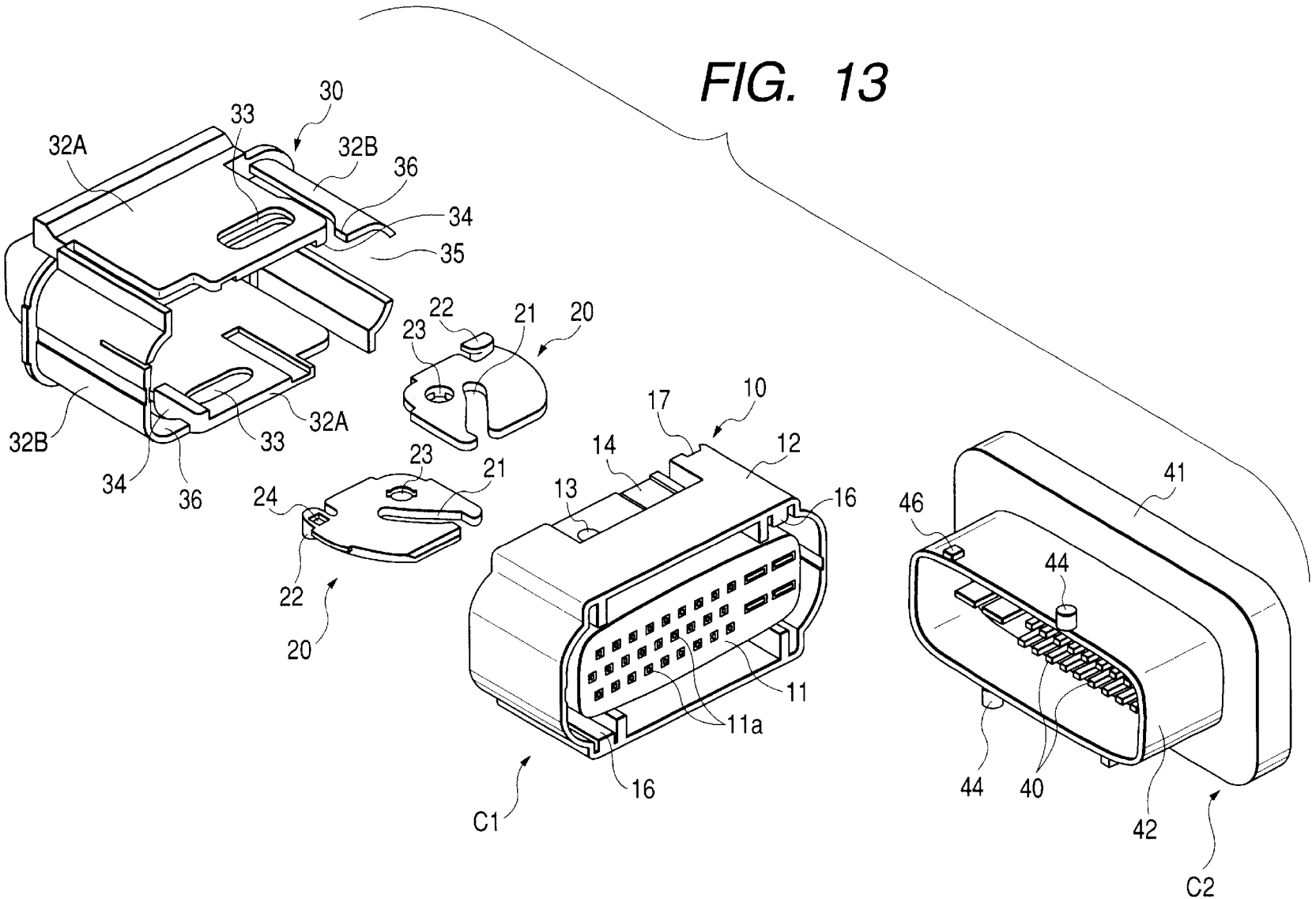
FIG. 13 is a perspective view showing a slider-equipped connector of an embodiment of the invention, and a counter connector.

FIG. 13 shows a slider-equipped connector C1 according to the invention, and a counter connector C2.

The counter connector C2 comprises a large number of terminals 40 which longitudinally elongate, and a resin-made housing 41 which holds the terminals 40. A hood 42 which externally surrounds the terminals 40 is formed on the housing 41. A pair of upper and lower cam pins 44, and a pair of upper and lower operation protrusions 46 are formed on the outer peripheral face of the hood 42.

By contrast, the connector C1 according to the invention comprises a housing 10, a pair of upper and lower cam plates (constituting the force boosting mechanism) 20, and a slider 30.

The housing 10 is integrally formed as a whole by an elastic insulating material such as a resin, and has a terminal holding portion 11 having a block-like shape, and a hood 12 which surrounds the terminal holding portion with forming an appropriate gap therebetween.

In the terminal holding portion 11, a large number of terminal accommodating chambers 11*a* are disposed so as to longitudinally pass through the terminal holding portion. Connector terminals (not shown) are held in the terminal accommodating chambers 11*a*, respectively, and wires connected to the connector terminals are led out to the rear side (the side where the slider 30 which will be described later is positioned) of the housing 10. The outer face of the terminal holding portion 11 is set so as to have a shape which allows the hood 42 of the counter connector C2 to be fitted onto the out side of the terminal holding portion (FIGS. 10 to 12).

On each of the upper and lower faces of the terminal holding portion 11, a support shaft portion 13 protrudes in a position in the vicinity of the rear end, and a bending piece 14 is formed.

The support shaft portions 13 function as swing fulcrums for the cam plates 20, and have a shape which is shown in detail in FIGS. 3A and 3B. Specifically, each of the support shaft portions 13 has a substantially columnar shape, and a pair of ears 13*a* protrude radially outward at an interval of 180° from a tip end side portion (in FIG. 3, the upper portion)

Each of the bending pieces 14 has a shape in which a tip end portion (the rear portion of the housing 10; in FIG. 2, the lower portion) can be flexurally deformed toward the inner side of the housing 10. As shown in FIGS. 7 to 9, specifically, a slit 18 which cuts into a peripheral portion of the terminal holding portion 11 from the rear side (the lower side in FIG. 7) is formed, so that the outer side with respect to the slit 18 functions as the bending piece 14. Therefore, the bending piece 14 can be inward flexurally deformed by a degree corresponding to the thickness of the slit 18. On the outer side face of the bending piece 14, a latching protrusion 14*a* for latching (restricting swinging of) the corresponding cam plate 20 is formed, and a pressed protrusion 14*b* is formed in a position on the side of the rear end (the lower end side in FIG. 7) with respect to the latching protrusion 14*a*.

A waterproof sealing member 15 is fixed to the whole circumference of the outer peripheral face of the terminal holding portion 11. The sealing member 15 is in contact with the inner peripheral face of the hood 42 of the counter connector C2 to seal a gap between the hood 42 and the terminal holding portion 11.

In an area between the terminal holding portion 11 and the hood 12, a pair of front and rear provisionally latching pieces (provisionally latching portion) 16 are formed. As shown in FIGS. 10 to 12, each of the provisionally latching pieces 16 is formed into a cantilevered shape which elongates from the inner side face of the front end (the upper end in the figures) of the hood 12, in a region outside the terminal holding portion 11, and in a rearward direction (namely, elongates in the connector fitting direction). A rear end portion 16*c* which is a free end can be bent in the outward direction (the direction approaching toward the hood 12). On the inner side face (the face on the side opposed to the terminal holding portion 11) of the provisionally latching piece 16, a provisionally latching protrusion 16*a* is formed, and a pressed protrusion 16*b* is formed in a position which is nearer to the front end than the provisionally latching protrusion 16*a*. The pressed protrusion 16*b* is formed in a position where, during an operation of coupling the connectors C1 and C2 with each other, the protrusion is pressed from the inner side by the corresponding operation protrusion 46 of the counter connector C2 (this function will be described later in detail).

Cutaways 17 through which the rear end portions (flexible end portions) 16*c* of the provisionally latching pieces 16 are respectively exposed to the outside are formed in a rear end portion of the hood 12, so that the rear end portions 16*c* of the provisionally latching pieces 16 can be pressingly operated also through the cutaways 17.

Alternatively, the provisionally latching pieces 16 may be elongated from the outer side faces of the terminal holding portion 11, instead of the inner side face of the hood 12.

Each of the cam plates 20 has a thin plate-like shape, and has a cam groove 21, a cam protrusion 22, and a shaft hole 23.

The cam groove 21 is passed through the cam plate 20 in the thickness direction, and has a smooth curve-like shape. The cam protrusion 22 protrudes toward the outside of the housing 10 in a position which is substantially diagonal to the cam groove 21. The shapes and positions of the cam groove 21 and the cam protrusion 22 are set so that, during an operation of coupling the connectors C1 and C2 with each other, the cam function (force boosting function) which will be described later is obtained in a state where the cam pin 44 of the counter connector C2 enters the cam groove 21 and the cam protrusion 22 is fitted into a cam groove 33 (which will be described later) of the slider 30.

The shaft hole 23 is a hole into which the support shaft portion 13 is to be fitted, and has a shape which is specifically shown in FIGS. 3A and 3B. Namely, the shaft hole 23 has a circular shape the diameter of which allows the protrusions 13*a* of the support shaft portion 13 to enter the hole. In the inner side in the thickness direction of the cam plate 20 (the lower side in FIG. 3), however, arcuate ridges 23*a* protrude radially inward from the inner peripheral face of the shaft hole 23 with leaving a pair of gaps 23*b* into which the protrusions 13*a* respectively enter.

Therefore, the support shaft portion 13 is fitted into the shaft hole 23 by entering the protrusions 13*a* into the gaps 23*b* at angle positions where the gaps 23*b* coincide with the protrusions 13*a*, respectively (FIG. 3A). After the fitting, the cam plate 20 is swung about the support shaft portion 13 to cause the protrusions 13*a* to override the ridges 23*a* (FIG. 3B), thereby preventing the cam plate 20 from slipping off from the support shaft portion 13. Namely, the cam plate 20 can be attached to the housing 10 so that the cam plate 20 is swingable about the support shaft portion 13.

On the rear side of the cam protrusion 22, formed is a recess 24 which is substantially identical in shape with the latching protrusion 14*a* on the housing 10. When the protrusion 14*a* is fitted into the recess 24, the cam plate 20 is latched to the swinging angle position. As shown in FIG. 2, the latching angle position is set to an angle position where the cam protrusion 22 of the cam plate 20 is positioned just at the rear end (the lower end in the figure) of the housing 10.

In the invention, the specific structure of the force boosting mechanism is not particularly restricted as far as it can generate a fitting force on the connectors in accordance with relative sliding between the housing and the slider.

The slider 30 is integrally formed as a whole by an elastic insulating material such as a resin in the same manner as the housing 10, and has a cover-like shape which covers the housing 10 from the rear side. More specifically, the slider has integrally a back wall 31 which is placed at the rearmost position, and a circumferential wall which extends from the peripheral edge of the back wall 31. The circumferential wall is divided into a pair of upper and lower flat plate-like side walls 32A, and right and left side walls 32B.

Each of the flat plate-like side walls 32A is configured so that the front end portion can be flexurally deformed in the inner and outer directions of the slider 30. The cam groove 33 is formed in a portion on the side of the front end. The cam groove 33 elongates in the lateral direction, and, in the illustrated example, is passed through the corresponding flat plate-like side wall 32A in the thickness direction. In a front end portion of each of the side walls 32A, a latching canceling protrusion 34 is formed so as to protrude from the inner side face of the wall. The positions of the latching canceling protrusions 34 are set so that, during an operation of mounting the slider 30 to the housing 10, the latching canceling protrusions 34 press the pressed protrusions 14*b* of the bending pieces 14 from the outer side, as shown in FIG. 9.

By contrast, in each of the right and left side walls 32B of the slider 30, a latched protrusion 36 which protrudes in the circumferential direction from a corner portion of the right or left side wall 32B is formed in a position corresponding to the provisionally latching piece 16. As shown in FIGS. 10A and 10B, the latched protrusions 36 bump from the rear side against the provisionally latching protrusions 16*a* of the provisionally latching pieces 16, whereby the slider 30 is restricted from being further moved beyond the bumping position (in other words, the slider is latched to a slide initial position coinciding with the bumping position).

A wire take-out groove 35 for leading a wire group D (see FIGS. 4 to 6 and 12B) connected to terminals of the housing 10 to the outside of the slider 30 is formed in one of the right and left side walls 32B.

Next, the manner of assembling the connector C1 and that of coupling the connector to the counter connector C2 after assembling will be described. The method of assembling the connector according to the invention is not restricted to this.

4) Attachment of the Cam Plates 20, and Mounting of Terminals

In the manner shown in FIGS. 3A and 3B, the cam plates 20 are attached to the housing 10 so that the cam plates 20 are swingable about the respective support shaft portions 13. The latching protrusions 14*a* of the housing 10 are fitted into the recesses 24 of the rear faces of the cam plates 20 to latch the cam plates 20 to a predetermined swinging angle position. The attachment of the cam plates 20 may be performed in parallel or simultaneously with attachment of the slider 30 which will be described later.

Terminals fixed to ends of wires are inserted into the terminal accommodating chambers 11*a*, respectively, and then fixed thereto. As a result of this step, the wire group D (FIGS. 4 to 6) connected to the terminals rearward elongates from the housing 10.

5) Attachment of the Slider 30

The slider 30 is mounted to the outer side of the housing 10 from the rear side of the housing 10 (FIGS. 4 to 6). During this mounting, as shown in FIG. 5, the flat plate-like side walls 32A of the slider 30 are outward flexurally deformed to override the cam protrusions 22 of the cam plates 20, and finally reaches a mounting position (FIG. 6) where the cam protrusions 22 are fitted into the cam grooves 33. In this mounting position, as shown in FIG. 10, the latched protrusions 36 of the slider 30 bump from the rear side against the provisionally latching protrusions 16*a* of the provisionally latching pieces 16 of the housing 10. Therefore, the slider 30 is restricted from being forward moved beyond the mounting position, so that the slider 30 is provisionally latched to the mounting position, i.e., the slide initial position.

At the timing when the slider 30 reaches the mounting position, as shown in FIG. 9, the latching canceling protrusions 34 disposed on the slider 30 press from the outer side the pressed protrusions 14*b* formed on the bending pieces 14, whereby the bending pieces 14 are inward bent. Therefore, the latching protrusions 14*a* formed on the bending pieces 14 are inward separated from the recesses 24 of the cam plates 20. Namely, the latching of the cam plates 20 by the latching protrusions 14*a* is automatically canceled to enable the cam plates 20 to exert the cam function.

When the slider 30 is mounted to the housing 10 in this way, the connector C1 is completed, and a state where the slider 30 covers from the rear side the wire group D (FIGS. 4 to 6) which rearward elongates from the housing 10 is attained. At this time, interference between the slider 30 and the wire group D is prevented from occurring, by the wire take-out groove 35 which is disposed in the side wall 32B of the slider 30.

When the provisional latching of the slider 30 by the provisionally latching pieces 16 is to be canceled in this stage, the rear end portions (flexible end portions) 16*c* of the provisionally latching pieces 16 are pressed with fingers or the like through the cutaways 17 formed in the hood 12. As a result of this operation, the engagement between the provisionally latching protrusions 16*a* of the provisionally latching pieces 16 and the latched protrusions 36 is canceled to enable the slider 30 to be deeply inserted into the housing 10. This operation is effective in, for example, in the case where the housing 10 and the slider 30 are transported together as a set.

6) Coupling with the Counter Connector C2 (FIGS. 10 to 12)

In the state where the slider 30 is mounted, the latching (restriction of swinging) of the cam plates 20 by the slider 30 is canceled. However, the cam plates 20 are restrained to the slider 30 by the engagement of the cam protrusions 22 and the cam grooves 33. As shown in FIG. 10, therefore, the cam plates are held to an angle position where the open ends of the cam grooves 21 are opened in the forward direction, or toward the counter connector C2.

Consequently, the operation of fitting the connectors C1 and C2 is performed by: nipping the slider 30 of the connector C1 with fingers or the like; entering the cam pins 44 of the counter connector C2 into the open ends of the cam grooves 21, and inserting the hood 42 of the counter connector C2 into the space defined by the terminal holding portion 11 of the connector C1 and the hood 12. In the fitting operation, the components function in the following manner.

When the hood 42 is to be inserted into the space, the operation protrusions 46 formed on the outer side face of the hood 42 press the pressed protrusions 16*b* of the provisionally latching pieces 16 in a direction from the inner side to the outer side as shown in FIG. 11, thereby causing the provisionally latching pieces 16 to be outward flexurally deformed. Therefore, the provisionally latching protrusions 16*a* formed on the provisionally latching pieces 16 are automatically outward disengaged from the latched protrusions 36 of the slider 30 (i.e., the provisional latching is canceled), thereby attaining a state where advancement (relative sliding motion with respect to the housing 10) of the slider 30 is enabled.

When the slider 30 is slidingly advanced as it is at this timing, the cam function between the cam grooves 33 of the slider 30 and the cam protrusions 22 causes the cam plates 20 to swing, and a large force of fitting the connectors C1 and C2 is generated by the cam function between the cam grooves 21 of the cam plates 20 and the cam pins 44. Namely, the operating force for sliding the slider 30 is boosted as a fitting force of the connectors by the cam function, so that the connectors C1 and C2 can be fitted with each other by a small operating force (FIG. 12).

In the invention, the specific shape and structure of the slider 30 are not particularly restricted as far as the slider can be attached to the housing 10 so as to be relatively slidable. For example, the slider may be formed into a cylindrical shape which does not have the back wall 31. In this case, the work of mounting terminals may be conducted after the slider 30 is mounted to the housing 10.

[Effects of the Invention]

As described above, according to the invention, in a connector in which a fitting force with respect to a counter connector is generated by relative sliding motion of a housing and a slider and a cam function of a cam member, a latching portion which disengageably latches the cam member to a swinging angle position where the cam member is engageable with the slider is disposed in the housing, so that a work of mounting the slider can be conducted while maintaining the latched state. Therefore, the invention attains an effect that the work of assembling the whole of the connector is facilitated and the production efficiency of the connector is improved while connector fitting by a small operating force is enabled by the cam function.

Further, according to the invention, in a slider-equipped connector comprising a force boosting mechanism, the provisionally latching portion for provisionally latching the slider to a slide initial position is disposed between the terminal holding portion of the connector housing and the hood surrounding the portion. Therefore, the invention can attain an effect that fitting of connectors can be realized by a small operating force although the structure is easy to handle and compact.

What is claimed is:

1. A connector comprising:

a housing which holds a terminal that is to be fitted with a counter connector;

a slider which is attached to said housing to be relatively slidable; and a cam member having a first cam portion which is engageable with a cam component disposed in said counter connector, and a second cam portion which is engageable with a cam component disposed in said slider, wherein shapes of said first and second cam portions are set so that, when said slider relatively slides with respect to said housing in a state where said first cam portion is engaged with said cam component of said counter connector and said second cam portion is engaged with said cam component of said slider, a sliding force is converted by a cam function of said cam member into a fitting force of said connectors which is larger than the sliding force, and said housing having a disengageable latching portion, said latching portion disengaged by a latching canceling portion provided on the slider so that said cam member is moved to a swinging angle position where said second cam portion is engageable with said slider.

2. The connector according to claim 1, further comprising:

a latching canceling portion which, when said slider is to be engaged with said second cam portion, compulsively cancels the latching of said cam member by said latching portion disposed in said slider.

3. The connector according to claim 2, further comprising:

a bending portion which is flexurally deformable in directions along which said bending portion is contacted with and separated from said slider disposed in said housing, wherein said latching portion is disposed in said bending portion, and, when said slider is to be engaged with said second cam portion, said latching canceling portion of said slider flexurally deforms said bending portion to displace said latching portion of said bending portion to compulsively canceling the latching.

4. The connector according to claim 3, wherein said latching canceling portion is a latching canceling protrusion which protrudes in a direction toward said bending portion, and said latching canceling protrusion presses said bending portion to flexurally deform said bending portion.

5. The connector according to claim 2, wherein said second cam portion is a cam protrusion which protrudes toward said slider, a cam groove into which said cam protrusion is to be fitted is disposed in a side wall of said slider, and during a period when said slider reaches a position where said cam protrusion is fitted into said cam groove, said side wall of said slider in which said cam groove is disposed overrides said cam protrusion while being flexurally deformed.

6. The connector according to claim 1, wherein said slider has a shape which covers from a rear side a wire connected to said terminal held by said housing.

7. A slider-equipped connector comprising:

a housing having a terminal holding portion which holds a terminal that is to be fitted with a counter connector;

a slider which is attached to said housing to be relatively slidable; and a force boosting mechanism which is interposed between said slider and said housing, and which converts a relative sliding force between said slider and said housing, into a fitting force with respect to said counter connector, said fitting force being larger than the sliding force, wherein a hood which surrounds said terminal holding portion with forming a gap between said portion and said hood is formed on said housing, and a provisionally latching portion is formed between said hood and said terminal holding portion, said provisionally latching portion provisionally latching said slider to a slide initial position in a state where said connector has not yet been fitted with said counter connector, and being flexurally deformed to cancel the provisional latching.

8. The slider-equipped connector according to claim 7, wherein said provisionally latching portion elongates from an inner side face of said hood in a connector fitting direction, and has a shape in which an end portion is flexurally deformable in directions along which said end portion is contacted with and separated from said inner side face of said hood.

9. The slider-equipped connector according to claim 8, further comprising:

a waterproof sealing member which is to be in contact with a housing of said counter connector disposed on an outer peripheral face of said terminal holding portion.

10. The slider-equipped connector according to claim 8, wherein said hood has a shape which allows said flexible end portion of said provisionally latching portion to be locally exposed to an outside of said hood.

11. The connector device comprising:

a slider-equipped connector according to claim 7, a counter connector having a housing that is to be fitted with said housing of said slider-equipped connector, and an operating portion disposed in said counter connector, wherein said operating portion, when said counter connector is to be fitted with said slider-equipped connector, operates said provisionally latching portion of said slider-equipped connector to deform said provisionally latching portion in a direction along which the provisional latching of said slider is canceled.

12. The connector device wherein said device comprising:

a slider-equipped connector according to claim 8, and a counter connector having a housing that is to be fitted with said housing of said slider-equipped connector, wherein said counter connector has a hood which is to be fitted to an outer side of said terminal holding portion of said slider-equipped connector, and an operation protrusion is formed on an outer peripheral face of said hood, said operation protrusion, when said counter connector is to be fitted with said slider-equipped connector, pressingly operating from an inner side said provisionally latching portion of said slider-equipped connector to deform said flexible end portion of said provisionally latching portion in a direction along which the provisional latching of said slider is canceled.

* * * * *